United States Patent [19]

Darnborough et al.

[11] 4,046,192

[45] Sept. 6, 1977

[54] METHOD AND APPARATUS FOR INSTALLING A CONTROL VALVE ASSEMBLY ON AN UNDERWATER WELL HEAD

[75] Inventors: Eric Darnborough, Chearn-Surrey, England; René Henri Coulboy, Sausset-les-Pins, France

[73] Assignee: Seal Petroleum Limited, London, England

[21] Appl. No.: 695,718

[22] Filed: June 14, 1976

[30] Foreign Application Priority Data

June 13, 1975 France ..... 75.18569

[51] Int. Cl.[2] ..... E21B 33/035

[52] U.S. Cl. ..... 166/.6

[58] Field of Search ..... 166/.5, .6

[56] References Cited

U.S. PATENT DOCUMENTS

| | | | |
|---|---|---|---|
| 3,163,224 | 12/1964 | Haeber et al. | 166/.6 |
| 3,179,176 | 4/1965 | Goepfert | 166/.6 |
| 3,486,556 | 12/1969 | Burgess | 166/.6 |
| 3,602,301 | 8/1971 | James | 166/.6 |
| 3,675,713 | 7/1972 | Watkins | 166/.6 |
| 3,913,669 | 10/1975 | Brun et al. | 166/.6 |

*Primary Examiner*—James A. Leppink

*Attorney, Agent, or Firm*—Sughrue, Rothwell, Mion, Zinn and Macpeak

[57] ABSTRACT

A method of installing a valve-bearing assembly on an underwater oil well head and for checking the sealing-tightness of the pipes connected thereto, in a single operation without the use of a diver, comprises coupling the assembly to a tool connected to riser of a surface support and which includes means for connection and checking of the assembly controlled from the surface support.

17 Claims, 16 Drawing Figures

19
20
21
46
17
18
57
14
13
15
1
16
44
11
33
22
29
12
28
23
25
37
6
39
45
7
55
37
8
5
3
5
2
47
48
9
4
40
42
41
43

1
4
6
22
33
47
48
58

METHOD AND APPARATUS FOR INSTALLING A CONTROL VALVE ASSEMBLY ON AN UNDERWATER WELL HEAD

This invention relates to the installation of a valve assembly on an underwater oil well head.

Various well-head installation methods have already been used or recommended which generally comprise successively lowering and guiding each part forming the underwater well-head, the various parts being in juxtaposed relationship so that the vertical piping is automatically connected by means known per se. All the known methods, however, even the most advanced, which more particularly do away with cables as guide lines, have the disadvantage of requiring at least one first lowering operation for a handling tool intended to position a first sealing-tight assembly on the well, and a second operation intended for lowering and installation of an assembly which at least includes a well-head master valve, while a third operation enables the master valve to be manoeuvred and various circuits of the well head to be checked.

These methods, which are made increasingly more difficult with increasing well-head depth, are complicated and relatively time-comsuming.

According to this invention there is provided a method of installing an assembly comprising at least one master valve on an underwater oil well head, comprising lowering by remote guidance and propulsion means connected to a tool comprising a first connection means for connection of said tool to said assembly, second connection means for connecting said assembly to said well head, means for checking the sealing-tightness of any circuits required, means for controlling said first and second connection means, for controlling any elements required inside said well, and raising said tool after checking said circuits and actuation of means for disconnection of said first connection means, wherein said operations is controlled from the surface by means of connections providing the required power.

Apart from the immediate advantage of this method whereby during a single descent the master valve bearer assembly and any other valves can be fixed while at the same time any well elements can be manoeuvred and the sealing-tightness of all the circuits associated with the said valves can be checked, the method has the further advantage of enabling the assembly to be installed irrespective of the state of the sea or, generally, the motion of the surface vessel bearing the tool. Pressure monitoring means can be associated with an adjustable damper support system provided on the master valve bearer assembly, it being only necessary to check and compare the pressure in the damper support system to effect the final stage in the vertical approach of the assembly on the well head casing without the use of auxiliary systems to counteract the ship motion.

The pressure in the damper support system may be controlled on impact of the master valve bearer assembly on the well during its installation.

There is also provided a tool for carrying out the above method and comprising a first connection means for connecting to said tool an assembly for installation on an underwater well, means connecting said tool to a surface support, means for controlling locking of second connecting means for connecting said assembly to the well, means for controlling the unlocking of said first connection means, means for controlling any elements required inside the well, means for checking the sealing-tightness of any pipes put into operation by valves of said assembly, wherein the control of said means is provided from said surface support.

The tool may include at least one system for checking and controlling the pressure of a damper system for controlling the descent of said assembly at the required speed until it is connected to the well head.

The tool may also comprise means for controlling the position of a support for the valve assembly in relation to a well base plate.

It is thus a simple matter to fix and monitor a valve assembly on the casing in a single operation, while the assembly may comprise any structure adapted subsequently to receive one or more other assemblies, it being possible for the load to be distributed over the well base by adjustment of the pressures exerted by the damper support system.

The tool may also comprise actuating means for the valves. With such a tool it is possible to lower the assembly with the valves open, fix it to the casing, check the pressure circuits, and raise the said tool, after the valves have been closed, in a single operation.

The present invention will be more fully understood from the following description of an embodiment thereof, given by way of example only with reference to the accompanying drawings.

Figure 1:
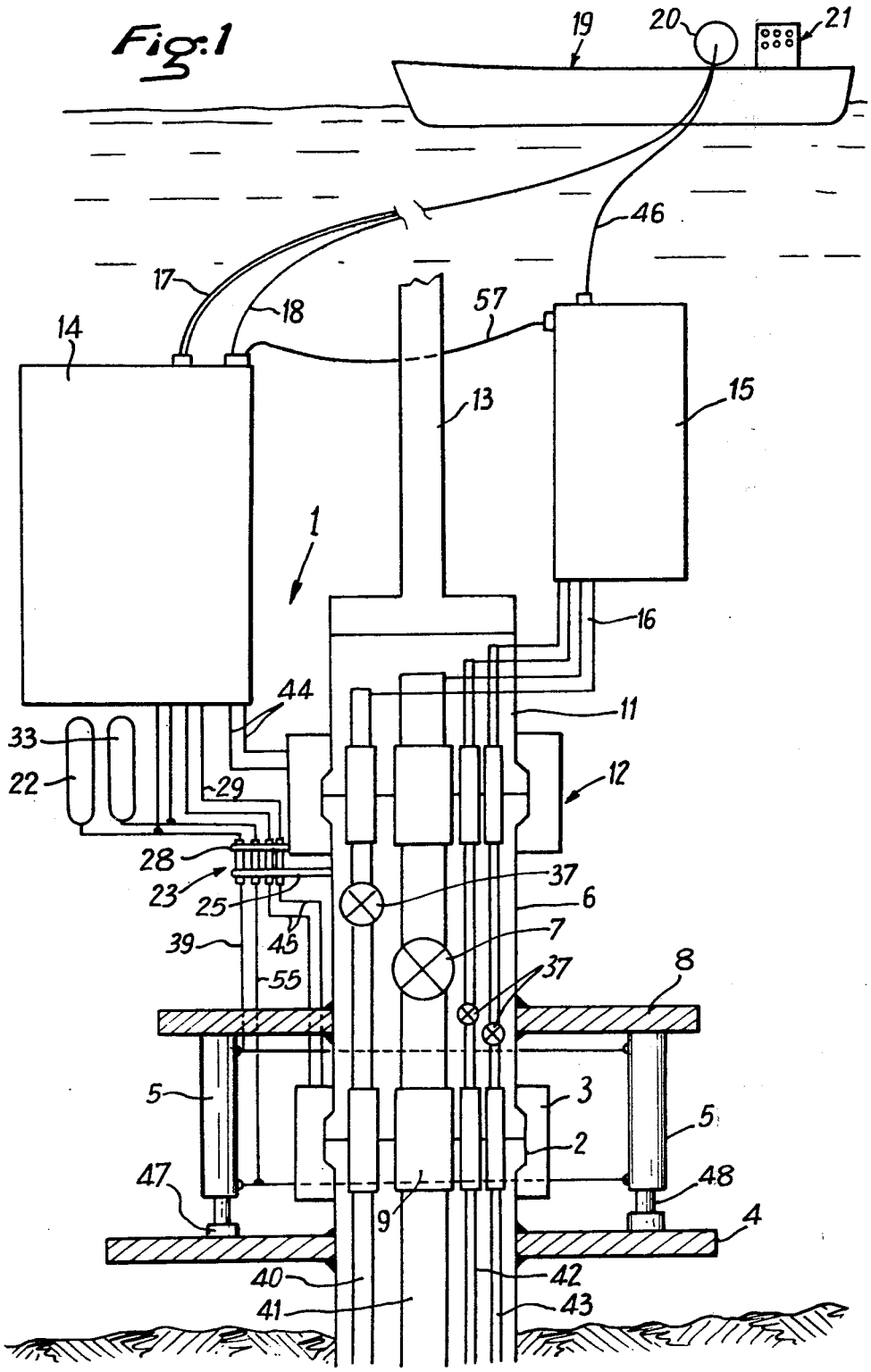
FIG. 1 is a diagrammatic view of an embodiment of a tool according to the invention, while still connected to a well head.

A tool assembly 1 is shown in FIG. 1 and comprises a central part 11 connected to the bottom end of a riser 13 suspended from a surface unit 19, a control box 14 for all the connector elements and jacks, a control box 15 for checking the sealing-tightness of various pipes 16 leading to the annular tube 40, the production tube 41 and the tubes 42 and 43 serving closure devices situated at lower levels but not illustrated in the drawing, and two connection units 12 and 23 connecting an assembly 6 bearing the master valve 7 to the tool and well respectively. The unit 12 comprises a conventional connector and connection unit 23 comprises commercially available hydraulic circuit connections.

Connector 12, which is controlled by circuits 44, establishes the connections between the pipes 16 and the tubes 40 to 43 and also provides mechanical locking of the central part 11 of the tool at the top part of the assembly 6. Unit 23 controls those elements of assembly 6 which require to be checked, connector 3 for example being controlled by the circuits 45. The hydraulic control circuits of unit 14 are fed via a flexible pipe 17 while the electrical supply is provided via cable 18. The supply to the hydraulic control circuits of unit 15 is by way of a high-pressure flexible pipe 46 while the power supply is by way of cable 57. Remote control of the complete assembly is carried out from a control desk 21 on the surface unit 19. A winch shown diagrammatically at 20 is used for paying out and winding in the supply lines 17, 18 and 46.

Figures 4, 5, 6, 7:
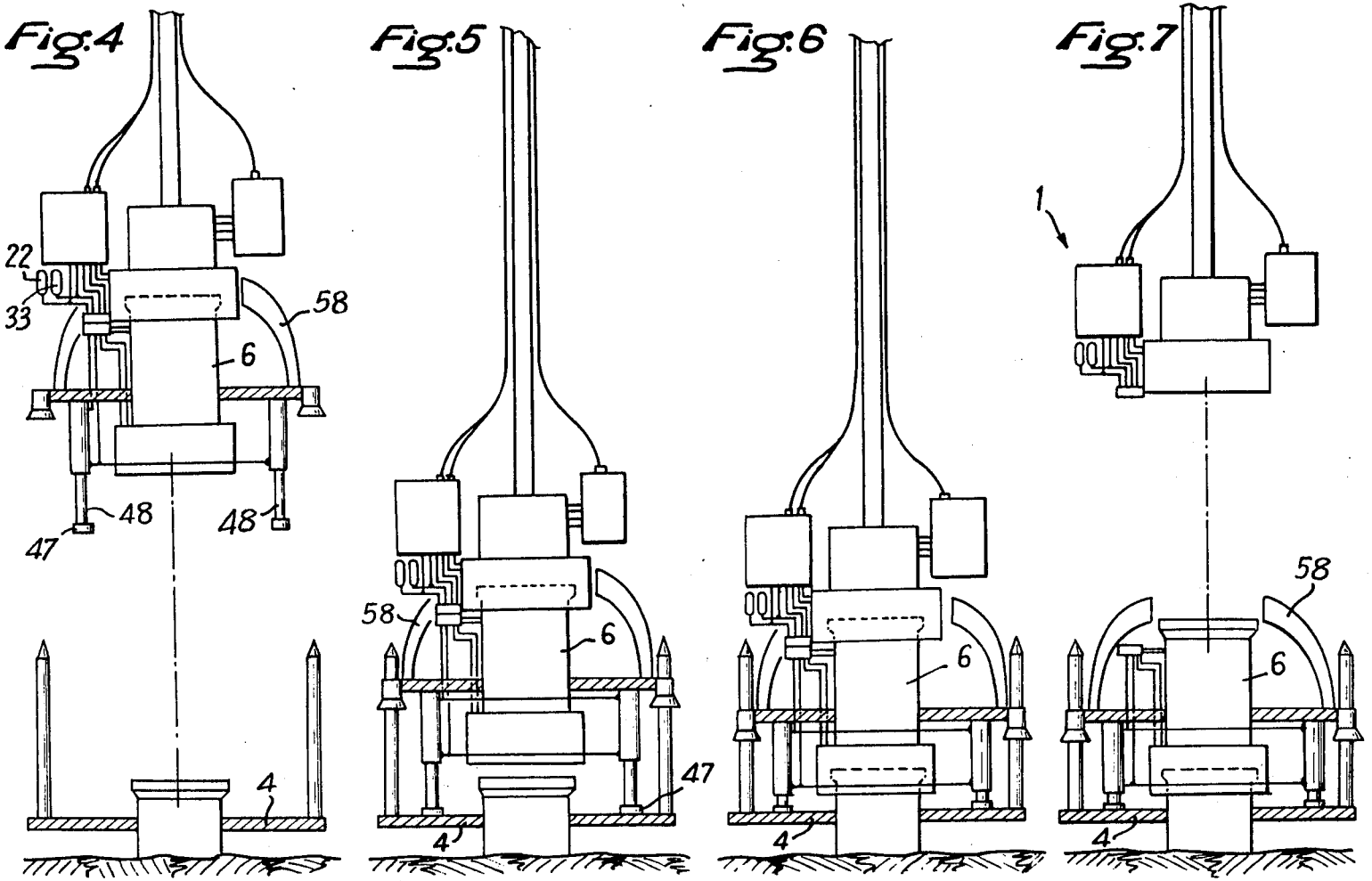
FIGS. 4 to 7 are diagrammatic views respectively of the descent, approach and installation of the assembly supported by the tool and the raising of the tool after disconnection from the assembly.
Figure 10:
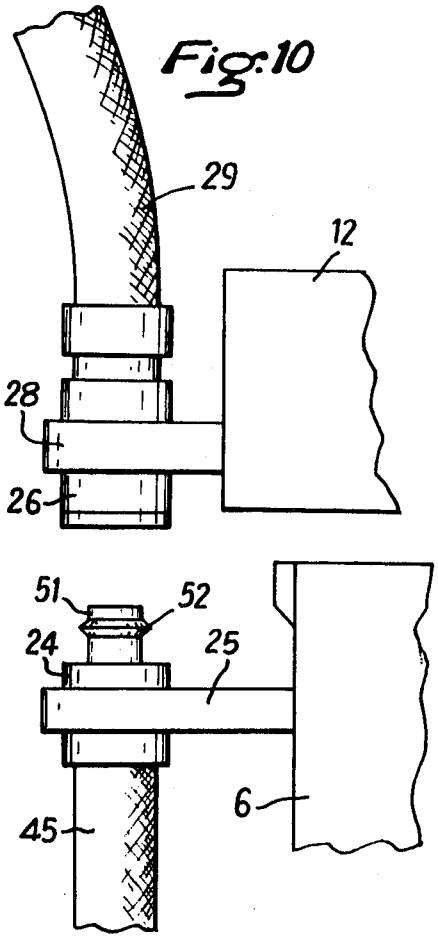
FIGS. 8 to 10 are diagrammatic views of the stages of disconnection of the means for connecting the hydraulic controls of the tool.
Figure 9:
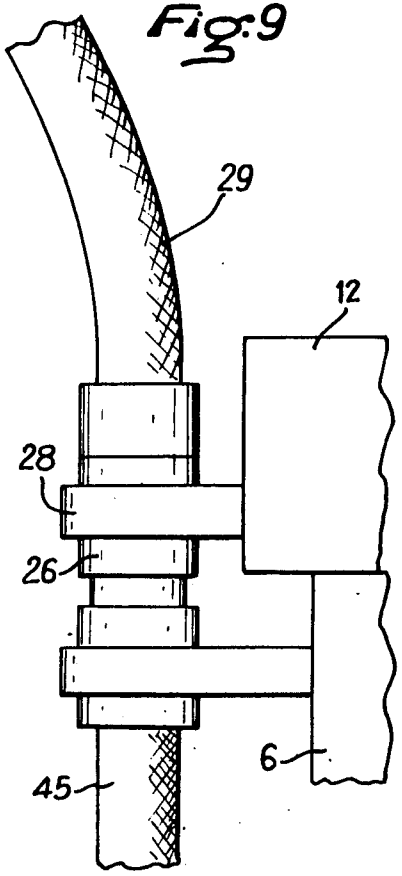
Figure 8:
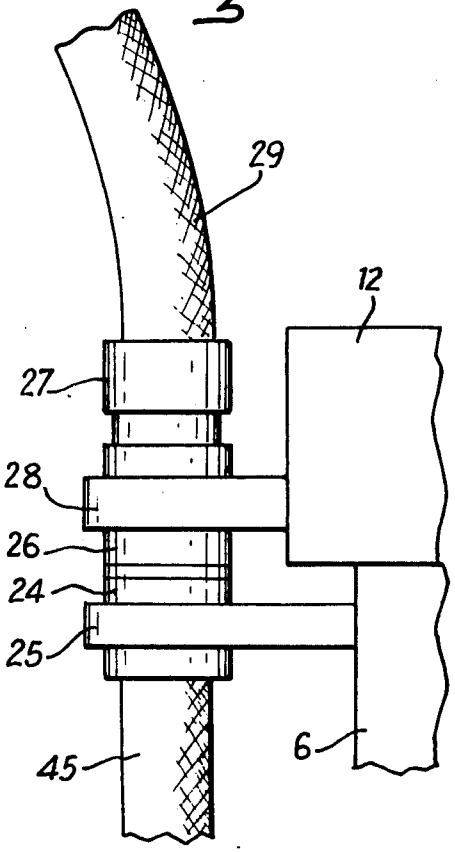

Assembly 6 comprises a support structure 8 comprising adjustable supports in the form of jacks 5, the ends 47 of their rods 48 resting on a base plate 4 connected to the casing 2. This support structure 8 may include guide structure, for example of the kind shown at 58 in FIG. 4, such structure being used for automatic assembly of any detachable self-contained control and monitoring unit lowerable on to the assembly 6 once the latter is in place. A support 25 forming part of assembly 6 bears the bottom connection elements 24, FIG. 8, of the connection unit 23, and a support 28 connected to connector 12 of tool 1 bears the upper connector sleeves 26. FIG. 8 shows the connection of circuit 29 to circuit 45 when the tool 1 bearing assembly 6 is lowered. On disconnection, FIG. 9, the connector 12 connected to the tool 1 lifts and lifts the sleeve 26 by way of the support 28, sleeve 26 abutting a retaining ring 27 after release of rings 52 and disengagement of socket 51, FIG. 10.

Of course the connecting unit 23 may be provided with connections of any other suitable type. Sealing may be provided inside the sleeve 26 by a suitable gasket.

Figure 3:
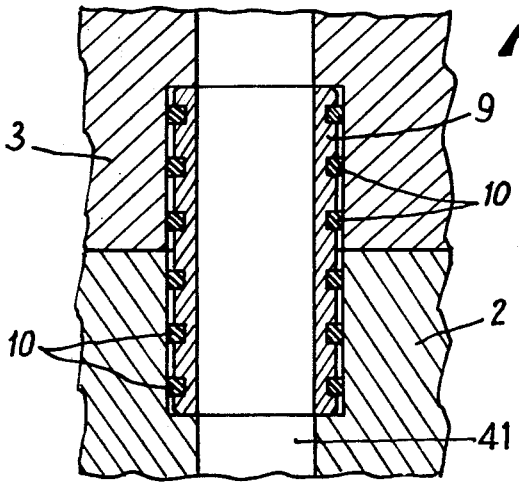
FIG. 3 is a diagrammatic view of a sleeve for connecting the lower part of a well head pipe to the upper part of the pipe.

FIGS. 1 and 3 show a pipe connecting sleeve 9 used with connectors 3 and 12. This sleeve is used to receive the top and bottom parts of the pipe 41. Gaskets 10 are provided on the sleeve 9 to seal the connector 3, e.g. in order to fix the assembly 6 on casing 2. Similar elements are provided for connecting the other pipe sections 40, 42, and 43.

The master valve 7 and the other control valves 37 are opened manually on the surface before installation. They are subsequently actuated by means of a tool which does not of itself form part of the invention.

Figure 16:
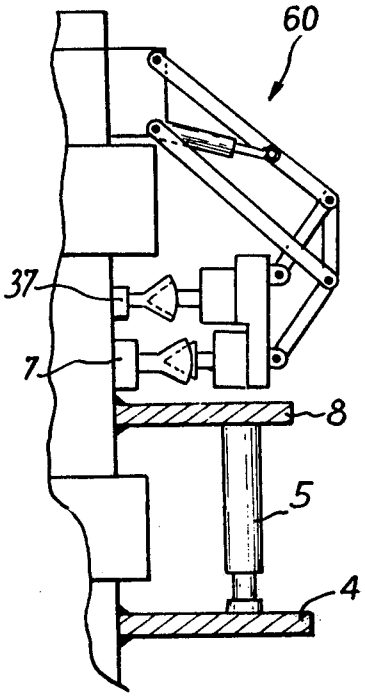
FIGS. 15 and 16 are diagrammatic views of a valve control tool in its withdrawn and operational positions.
Figure 15:
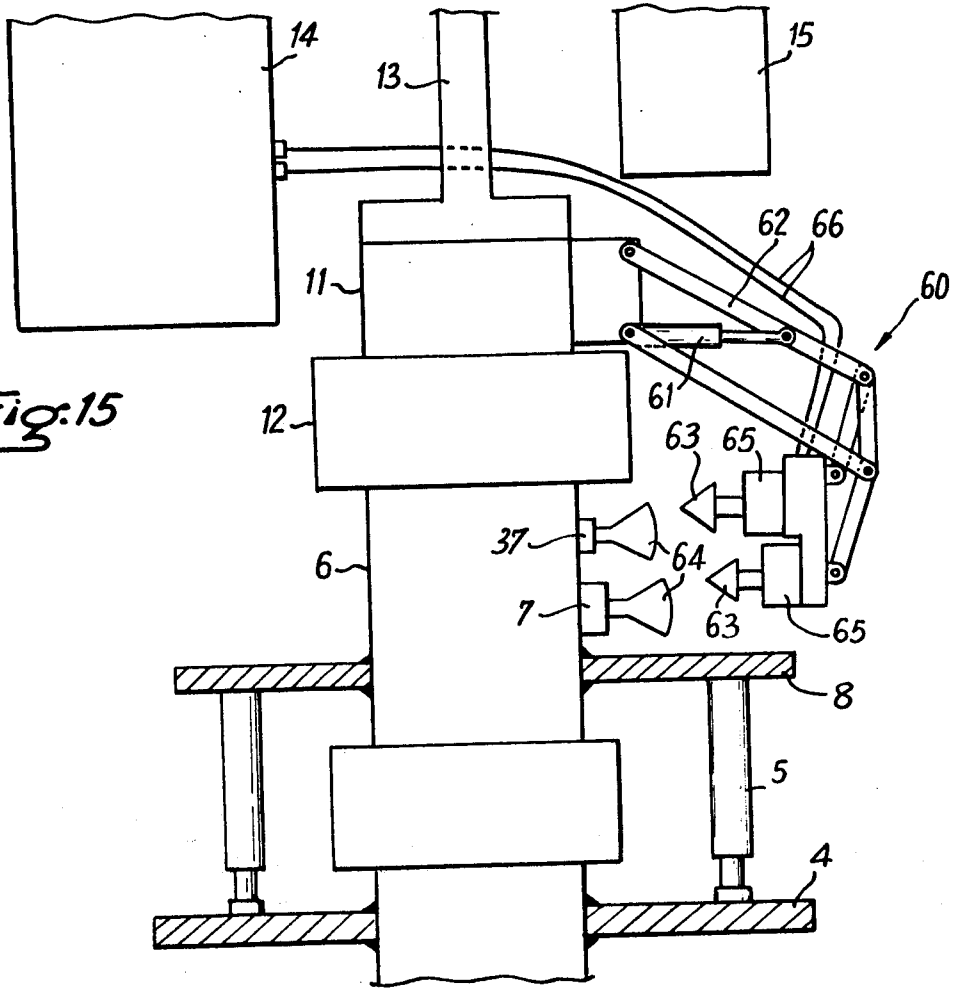

An element 60, FIG. 15, may also be provided for actuating the valves 7 and 37 and be fixed, for example, to the central part 11 of tool 1. This element consists of an articulated assembly which can be raised into the position shown in FIG. 15 or into the operating position shown in FIG. 16, by means of a jack 61 articulated on an arm 62. In the operating position, nipples 63 engage in bowls 64 of corresponding shape connected to the rotary spindles of these valves. Rotation of the nipples 63 is effected by hydraulic control from the control desk 21 on the surface support 19. To this end, drive mechanisms 65 for the nipples 63 are connected by the hydraulic lines 66 to the control unit 14.

In this way, valves 7 and 37 can be actuated by the installation tool 1 after the nipples 63 have been engaged in the bowls 64 and the installation tool 1 can be re-surfaced simply by lifting element 60 by means of jack 61 after the valves have been actuated.

Figure 2:
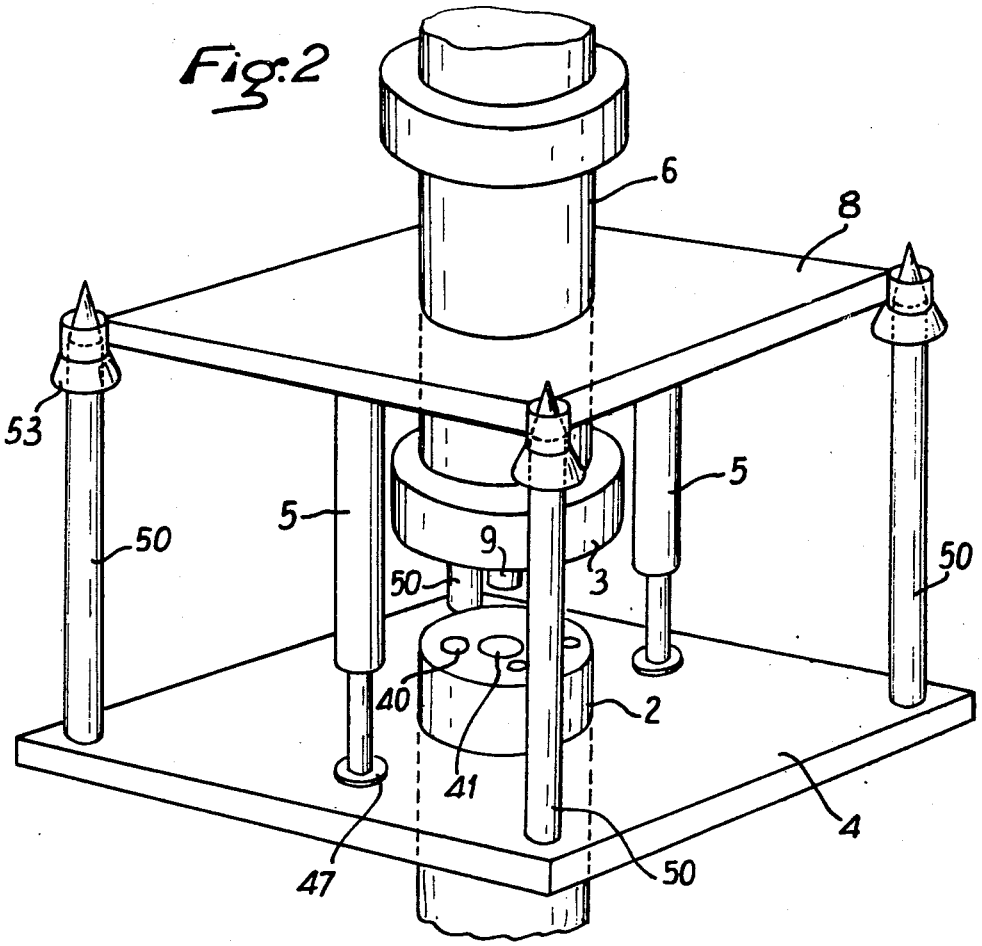
FIG. 2 is a partially broken-away view showing the detail of the base of the well-head receiving the support for the master valve bearer assembly.

Although FIG. 2 shows the baseplate 4 of casing 2 with four guide columns 50 receiving guide cones 53 on the structure 8 and two jacks 5, the plate 4, structure 8 and damper supports 5 may of course have a different form.

Figure 11:
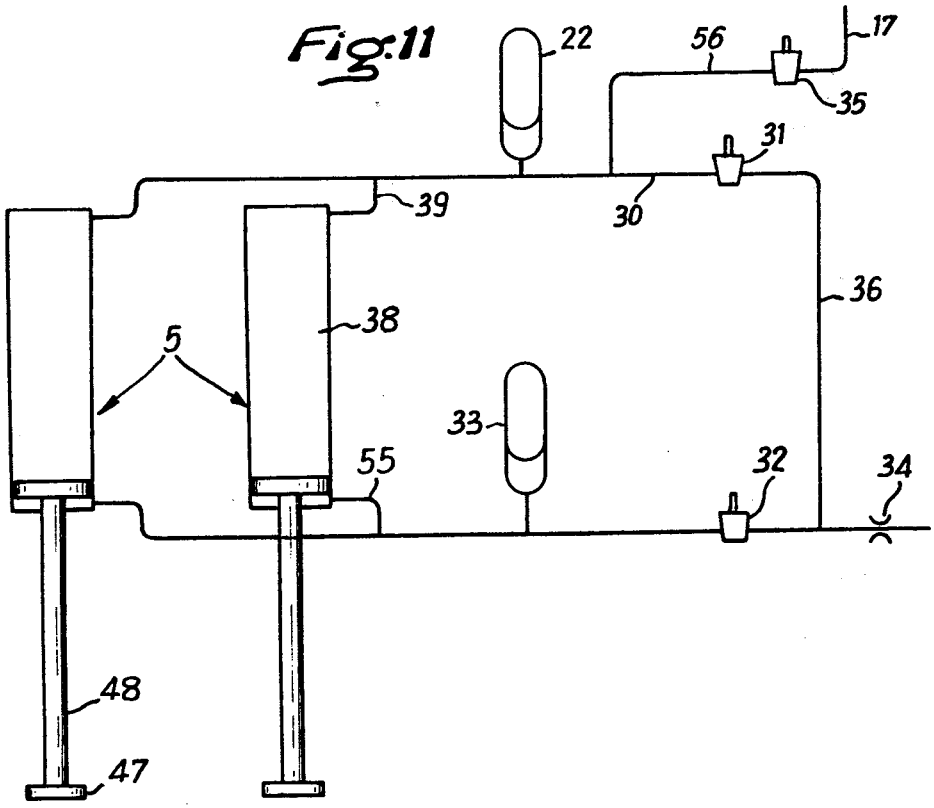
FIGS. 11 to 14 are diagrammatic views of a damper circuit during the approach and fixing stages.
Figure 12:
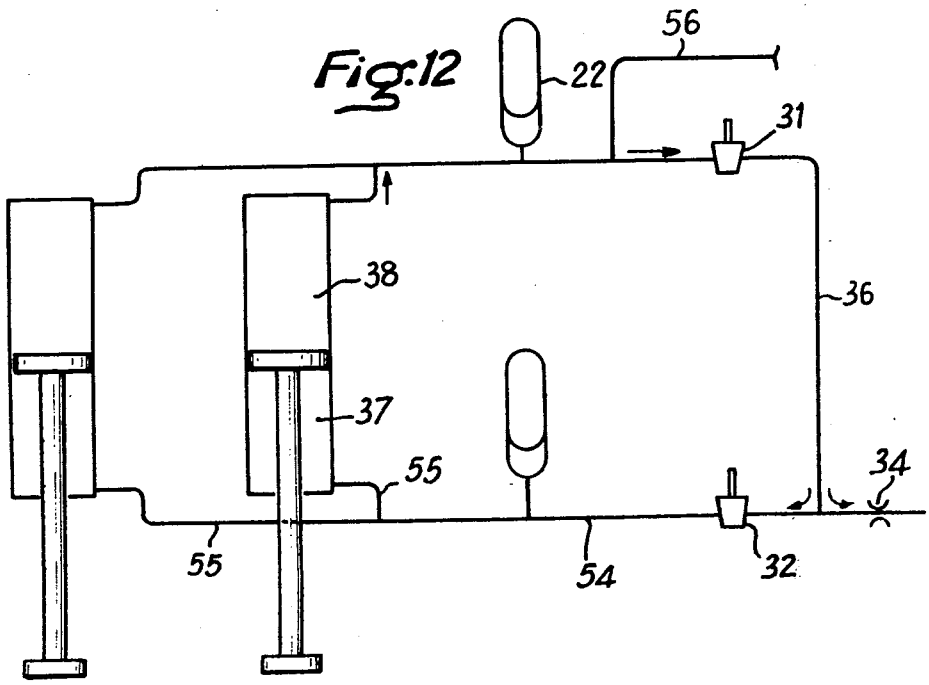

To facilitate the description of the control circuits for the jacks 5, reference will first be made to FIGS. 4 to 7. During the lowering stage, FIG. 4, the rods 48 are completely extended so that when their ends 47, FIG. 5, contact the baseplate 4 the pistons of the jacks 5 connected to the rods 48 compress the oil and gas contained in pressure accumulators 22 connected to the jack chambers by hydraulic circuits as shown in FIG. 11. From this Figure it will be seen that the top chambers 38 of the jacks 5 are connected by lines 39 to the pressure accumulator 22, the solenoid valve 31 in circuit 30 which is an extension of line 39 being open during the approach manoeuvre whereby the excess oil can flow slowly away via circuit 36 into the sea through the throttle duct 34. On the other hand, the lower chambers 37, FIG. 12, are connected via circuits 55 to accumulator 33 which can discharge during the approach stage only into chamber 37, since solenoid valve 32 of circuit 54 shuts off access to the throttle 34.

Thus during the entire descent of the tool 1 and assembly 6 the jacks 5 act as dampers firstly because of the very slow escape of the oil contained in the chambers 38 and secondly because of their connection to the tool accumulators, the rods 48 being adapted to retraction at the required speed.

Figure 13:
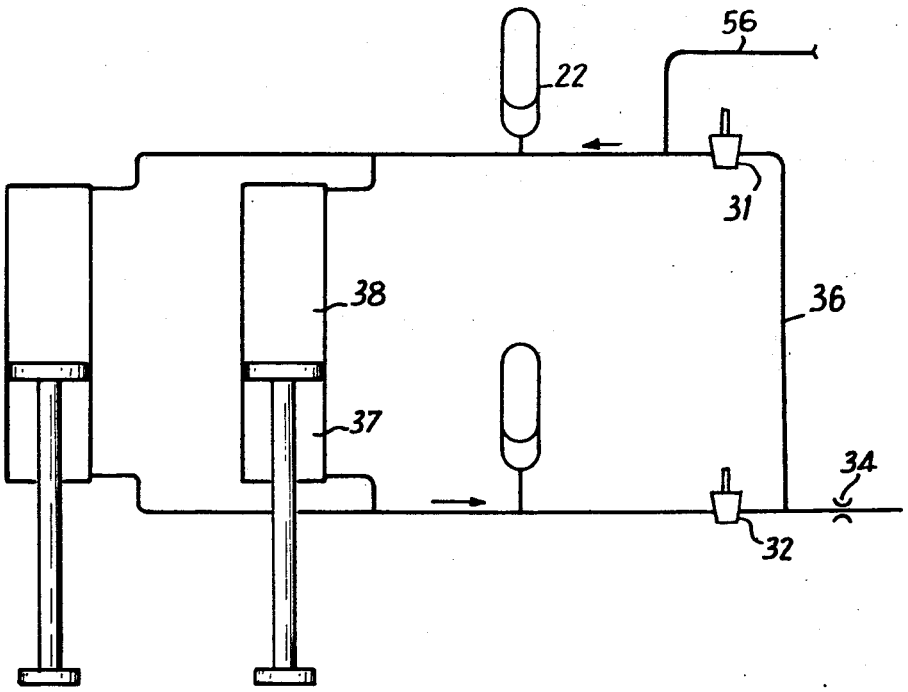

In order to control the raising of the tool 1 and its separation from the assembly 6, a solenoid valve 35 disposed between line 17 and conduit 56 connected to circuit 30 enables oil to be fed, when said valve is open, from the surface to chambers 38 so that the tool can be raised as shown in FIG. 13.

Solenoid valve 31 is then closed while solenoid valve 32 is open to allow the oil contained in the chambers 37 to escape progressively via the throttle 34.

The result is a convenient means of installing the assembly 6 and withdrawing the tool. After complete lowering of the assembly 6 the connector 3 is locked by a control signal from desk 21. The tool is then withdrawn after connector 12 has been unlocked by a control signal from desk 21.

Figure 14:
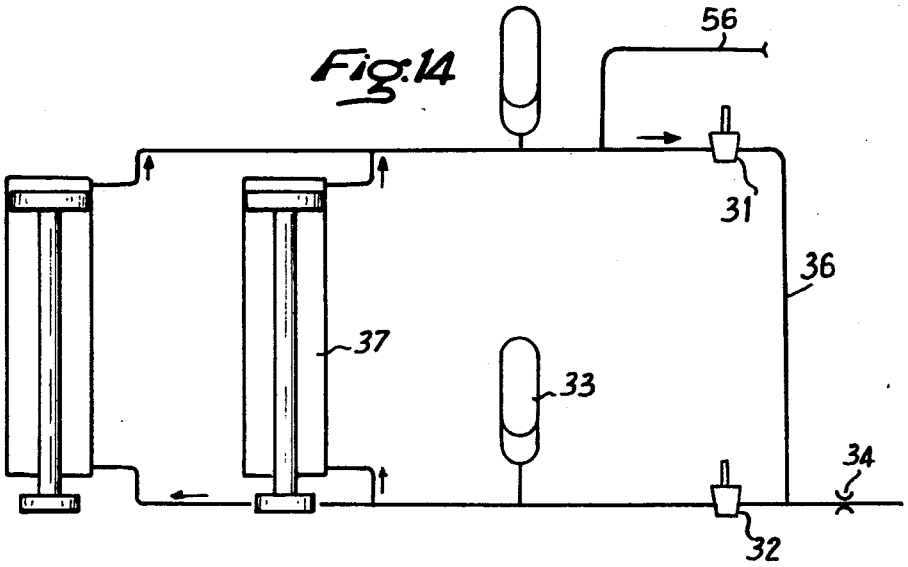

It will be seen that during the entire lowering of the assembly 6 the load of the jacks on the baseplate 4 is checked and the operation of locking the connector 3 may be effected either after complete retraction of the jack rods 48 by opening the solenoid valve 31, FIG. 14, or when the ends 47 of the rods rest on the plate, by exerting a predetermined pressure.

The control systems for the elements of the oil well which are known per se, have not therefore been described, and the same applies to the various monitor circuits for the pressures and rates of flow which are controlled at the control station 21. Also, although the tool described is a preferred embodiment thereof, numerous additions, replacements or modifications as to detail may of course be made to the components described, including the arrangement of solenoid valves and throttle ducts, without thereby departing from the general spirit of the invention.

There is thus provided a method of placing a valve assembly on an underwater oil well head in a single operation while ensuring immediate checking of the sealing-tightness of the circuits brought into operation by said valves, the operation being carried out without the use of a diver whether the valves are or are not controlled after the assembly has been fixed.

What is claimed is:

1. A method of installing an underwater assembly comprising at least one master valve on an underwater oil well head, comprising the steps of: lowering in a non-rigid manner by remote guidance and propulsion means connected to a tool comprising a first connection means for connection of said tool to said assembly, second connections means for connecting said assembly to said well head, means for checking the sealing-tightness of any circuits required; controlling from the surface said first and second connection means, and for controlling any elements required inside said well; raising said tool after checking said circuits; and actuation of means for disconnection of said first connection means, wherein said operations are controlled from the surface by means of flexible connections providing the required power.

2. A method as claimed in claim 1, including the step of lowering said master valve in the open position.

3. A method as claimed in claim 2, including the step of raising said tool after closing said master valve.

4. A method as claimed in claim 1, including the step of distributing the load of said assembly by jacks over a base plate of said well head before said second connection means is locked.

5. A method as claimed in claim 1, including the steps of approach and positioning of said assembly, said steps effected by means of a damper system.

6. A method as claimed in claim 5, wherein said approach and position of said assembly is controlled with respect to its final position by controlling said damper systems.

7. A method as claimed in claim 1, wherein the connection operation is effected by a vertical movement.

8. A method as claimed in claim 1, wherein the said assembly includes a structure for bearing on the base of the well through an adjustable support means.

9. A method as claimed in claim 8, wherein said structure is provided with guide means for subsequent installation of a selfcontained control assembly.

10. A method as claimed in claim 1, comprising the step of connecting retractable actuating means for the valve assembly to the well.

11. A method for performing the method claimed in claim 1, including the steps of using tools comprising a first connection means for connecting to said tool an assembly for installation on an underwater well, means connecting said tool to a surface support, means for controlling locking of second connecting means for connecting said assembly to the well, means for controlling the unlocking of said first connection means, means for controlling any elements required inside the well, means for checking the sealing-tightness of any pipes put into operation by valves of said assembly, wherein the control of said means is provided from said surface support.

12. A method as claimed in claim 11, including the step of bringing each pipe into operation by a valve of said assembly and connecting to a sealing-tightness checking line of the said sealing-tightness checking means.

13. A method as claimed in claim 11, including the step of connecting the control circuits for the various control elements on said assembly or in the well vertically by hydraulic connections mounted on said assembly.

14. A method as claimed in claim 11, including the steps of connecting said first connection means to the riser of said surface support, and connecting said control circuits and sealing-tightness checking circuits to said surface support by flexible lines.

15. A method as claimed in claim 11 including the step of using a damper system for approach of said assembly.

16. A method as claimed in claim 15, wherein said damper system comprises pressure accumulators connected to said assembly.

17. A method as claimed in claim 16, including the step of connecting the connections of said damper system to said jack chambers via at least a first solenoid valve to said control means for controlling the extension of said rods of said jack by filling one of the chambers, and by at least one circuit comprising a second solenoid valve and a throttle duct communicating with the ambient medium, said circuit being connected to the other chamber, such that extension and retraction of the rods of said jacks are effected at the required speed.

* * * * *